US007946970B2

(12) United States Patent
Garza, Jr. et al.

(10) Patent No.: US 7,946,970 B2
(45) Date of Patent: May 24, 2011

(54) EXERCISE KIT

(76) Inventors: Gerardo Garza, Jr., San Antonio, TX (US); Isaac M. Garza, San Antonio, TX (US); Magdiel O. Garza, San Antonio, TX (US); Ninfa M. Garza, San Antonio, TX (US)

( * ) Notice: Subject to any disclaimer, the term of this patent is extended or adjusted under 35 U.S.C. 154(b) by 18 days.

(21) Appl. No.: 12/618,486

(22) Filed: Nov. 13, 2009

(65) Prior Publication Data

US 2010/0126902 A1 May 27, 2010

Related U.S. Application Data

(60) Provisional application No. 61/117,467, filed on Nov. 24, 2008.

(51) Int. Cl.
*A63B 21/02* (2006.01)

(52) U.S. Cl. ..... 482/126; 482/40; 482/122; 482/124; 482/125; 206/579; 206/315.1

(58) Field of Classification Search ..... 482/40, 482/92, 121–126, 129, 130, 141, 148, 145, 482/146, 79, 80, 904; 206/579, 570, 315.1
See application file for complete search history.

(56) References Cited

U.S. PATENT DOCUMENTS

| | | | | |
|---|---|---|---|---|
| 4,685,671 | A * | 8/1987 | Hagerman et al. | 482/124 |
| 4,826,159 | A | 5/1989 | Hersey | |
| 4,974,836 | A | 12/1990 | Hirsch | |
| 5,176,602 | A * | 1/1993 | Roberts | 482/131 |
| 5,318,493 | A | 6/1994 | Brady | |
| 5,318,494 | A * | 6/1994 | Santighian | 482/125 |
| 5,658,222 | A | 8/1997 | Brown | |
| 5,674,163 | A * | 10/1997 | Sennett | 482/125 |
| 6,036,625 | A | 3/2000 | Woodruff | |
| 6,494,817 | B2 | 12/2002 | Lake | |
| 6,626,807 | B1 | 9/2003 | Richmond | |
| 6,887,187 | B1 | 5/2005 | Renz | |
| 7,001,315 | B1 | 2/2006 | Diodati | |
| 7,044,901 | B2 | 5/2006 | Weir | |
| 7,108,641 | B2 | 9/2006 | Pertegaz-Esteban | |
| 7,137,935 | B2 * | 11/2006 | Clarke et al. | 482/123 |
| 7,322,908 | B2 | 1/2008 | DiGiacomo | |
| 7,364,538 | B2 | 4/2008 | Aucamp | |
| 7,370,763 | B1 | 5/2008 | Pascucci | |
| 7,425,190 | B2 | 9/2008 | Kolarick et al. | |
| 2002/0187884 | A1 * | 12/2002 | McGrath | 482/121 |
| 2003/0148865 | A1 * | 8/2003 | Handshoe | 482/148 |
| 2005/0059537 | A1 * | 3/2005 | Hull | 482/124 |
| 2005/0170937 | A1 * | 8/2005 | van Straaten | 482/124 |
| 2005/0272578 | A1 * | 12/2005 | Widdershoven et al. | 482/124 |
| 2006/0084556 | A1 * | 4/2006 | Payne | 482/121 |
| 2006/0189459 | A1 * | 8/2006 | Hsu | 482/125 |
| 2008/0214369 | A1 * | 9/2008 | Mancini | 482/121 |
| 2009/0075790 | A1 * | 3/2009 | Hetrick | 482/92 |

* cited by examiner

*Primary Examiner* — David T Fidei
(74) *Attorney, Agent, or Firm* — Gunn Lee & Cave, P.C.

(57) ABSTRACT

A kit is provided so a person can exercise anywhere the person may be located. Body rockers have a handle to grip, which body rockers alone may be used by a user for many exercises. Elastic cords of varying lengths and strength may be attached to the body rockers with carabiners. By securing a part of the elastic cord to a stationary object, the limbs of the body can be exercised as well as abs and upper body. Door stops may be used to secure the elastic cords between a door and door frame. A rocker cover can be used for back and forth rocking motion of the user. All of these items may be loaded in a workout bag and carried with the user to exercise wherever the user may be located.

10 Claims, 8 Drawing Sheets

EXERCISE KIT

BACKGROUND OF THE INVENTION

1. Field of the Invention

This invention relates exercise equipment and, more particularly, to a portable exercise kit someone can take with them and exercise anywhere.

2. Brief Description of the Prior Art

As our society transitions from a labor intensive society to a computer based service society, people get less and less exercise. Because of the sedentary nature of the work environment, it is important to be able to get exercise whenever and wherever possible. If a person is traveling and staying in a hotel and/or motel, being able to exercise is important to one's well being. A person that is physically fit is also sharper mentally and is more productive in the work place. A person that is physically fit misses fewer work days and is less of an administrative burden on the employer.

There are literally thousands of different types of inventions on exercise systems. Such exercise systems may range from complicated pieces of exercise equipment to foldable exercise equipment that may fold down into the size of a suit case such as shown in U.S. Pat. No. 5,658,222 to Brown. Brown's invention is for a portable personal gym that folds down to suitcase size that can be used for aerobic exercise while traveling.

More complex exercise equipment is shown in U.S. Pat. No. 7,108,641 to Pertegaz-Esteban. While a very complex piece of exercise equipment is shown, the primary thrust of the invention is to the multi-positioning handles The exercise equipment patented by Richmond in U.S. Pat. No. 6,626,807 is somewhat less complex, but has platforms for supporting the users arms and knees. Rollers provide for movement between the two units.

If a swimming pool is available, Kolarick et al. provides a personal flotation exercise kit as shown in U.S. Pat. No. 7,425,190. The individual can adjust the exercise kit for their body size and the water provides the resistance.

Renz provides a convertible exercise equipment in U.S. Pat. No. 6,887,187 that can be carried around in a carrying case. However, the equipment as shown in Renz is more for static exercise than dynamic exercise.

Equipment to exercise the upper body is shown in Woodruff, U.S. Pat. No. 6,036,625, which includes a head strap for attaching through an elastic member to a stationary object. Woodruff does recognize the benefits of working against a dynamic resistance provided by an elastic strap.

Mobile exercise equipment is shown in Aucamp, U.S. Pat. No. 7,364,538. Aucamp uses a rope that may be lengthen or shortened that connects through a platform via pullies with exercise being against the platform.

There are many other types of exercise devices, both in kit form and in stationary form. As our society becomes more sedate with people becoming much larger, there is an increased concern about exercise to maintain our health and well being. Different people have different preferences for the type of exercise they do.

The outdoor person may hike or backpack as a form of recreation and exercise. Others may prefer running or riding a bicycle. As exercise equipment has been developed, these type of exercised can be done inside. However, the equipment is large and stationary. Other people prefer to participate in sports for their exercise, but this depends upon a group of people and a location where the sport can be played.

For the person that is on the go, they need to be able to exercise wherever they may be located. This means any exercise equipment must also be lightweight and portable.

SUMMARY OF THE INVENTION

It is an object of the present invention to provide portable exercise equipment an individual can take with them.

It is another object of the present invention to provide an exercise kit that is simple and easy to use wherever one may be staying.

It is yet another object of the present invention to provide a "gym in a bag" type of exercise equipment that provides for aerobic conditioning while working against stationary objects.

The kit includes body rockers that are arcuate shaped with a handle extending between opposing sides of the arch. The body rocker has numerous holes therein to which elastic cords may be attached by carabiners or other similar types of attaching devices. By having elastic cords of varying lengths and strengths, an individual can use the body rockers to do all types of exercises. A web strap is provided to attach between doors and door frames to provide a stationary object against which the elastic cords may be attached for dynamic exercise. The body rockers may also be used to provided back and forth motion for the body while performing the aerobic exercise. All of the exercise equipment that an individual will need, complete with instructions. A CD and a bag in which to carry everything, make up an exercise kit. The exercise kit is small and light enough that an individual may take the exercise kit wherever he/she may go.

The outer surface of the body rockers is covered with a nonscratch elastic material such as rubber. This prevents slipping of the body rockers and scratching of surfaces by the body rockers. When someone is using the body rocker to stand on and rock back and forth, a rocker cover may be necessary that will attach to the body rocker. The rocker cover must be of sufficient strength to support the individual.

DESCRIPTION OF THE PREFERRED EMBODIMENT

Figure 1:
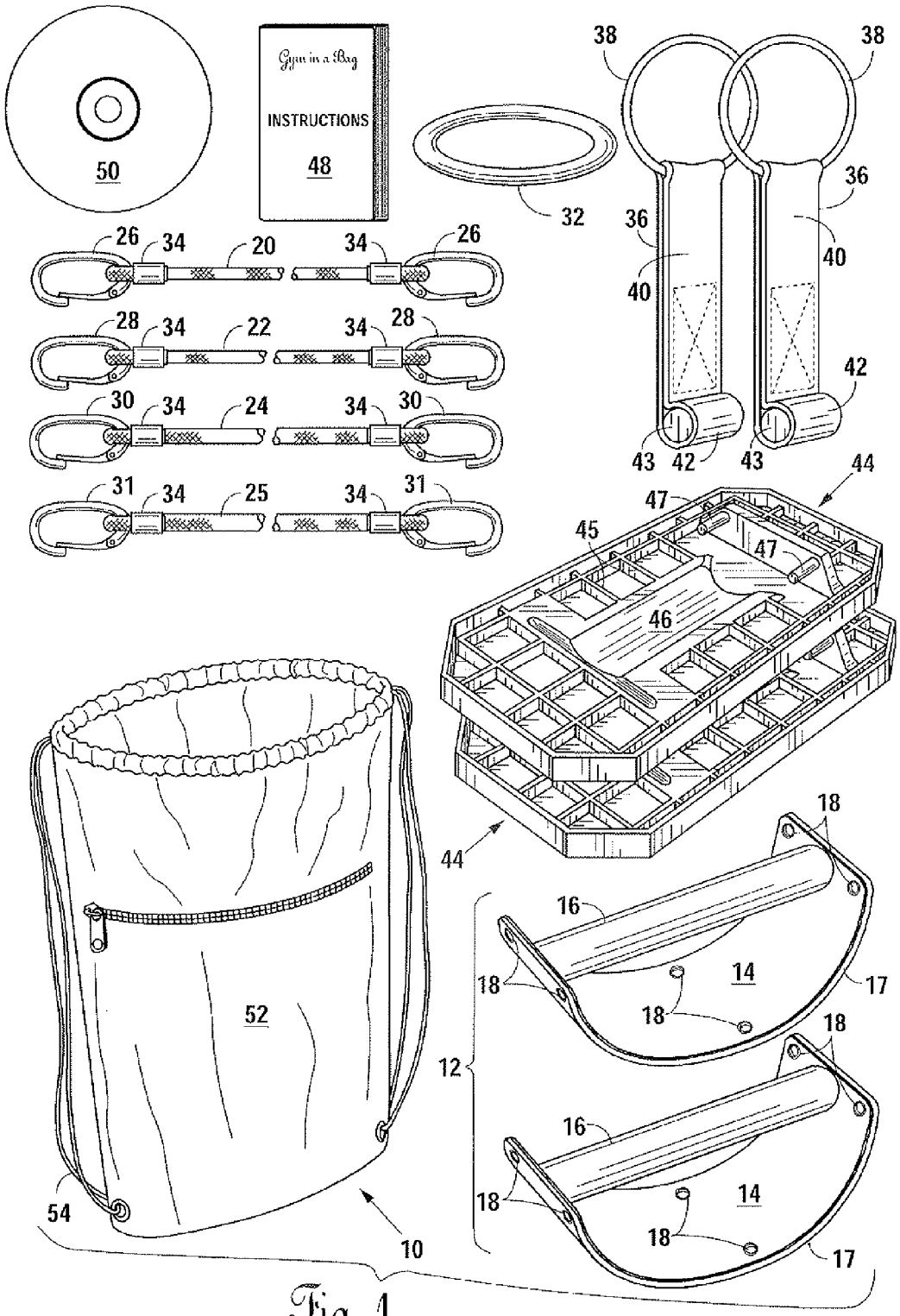
FIG. 1 is an exploded perspective view showing various items included in an exercise kit of the present invention.

An exercise kit is shown in FIG. 1 and is represented generally by the reference numeral 10. The exercise kits include a plurality of body rockers 12 with at least two being included per kit and sometimes four per kit. The body rockers 12 have an arcuate plate 14 with a handle 16 being connected between opposing ends of the arcuate plate 14. The arcuate plate 12 is covered with an elastic gripping material 17. Holes 18 are provided through each corner of the arcuate plate 14 and on each side in the middle of the arcuate plate 14 along with the elastic gripping material 17.

A series of elastic cords 20, 22, 24 and 25 are provided of varying lengths and strengths. Other elastic cords of different lengths and strengths may be used. On each end of the elastic cords 20, 22, 24 and 25 are located carabiners 26, 28, 30 and 31 respectively. The ends of the elastic cords 20, 22, 24 and 25 extend through the carabiners 26, 28, 30 and 31 respectively with a retaining loop 34 holding each of the elastic cords 20, 22, 24 and 25 firmly looped over carabiners 26, 28, 30 and 31 respectively. The retaining loops 34 may be a suitable shrink wrap type material that can cover a knot such as a FIG. 8 knot, or a bowline knot at the ends of elastic cords 20, 22, 24 or 25. Also, the ends of the elastic cords 20, 22, 24 and 25 can be frapped into place with the retaining loop 34 covering the frapping material.

Also included as part of the exercise kit is a solid ring 32 that can be used in a manner as will be described subsequently.

At least a pair of door straps 36 are provided per exercise kit 10. The door straps 36 have rings 38 sewn into one end of flexible material 40. On the opposite end of flexible material 40 from the retaining ring 38 is located a retaining loop 42 into which any type of plug 43 may be inserted. All that is necessary is the plug 43 be solid enough so that it cannot be pulled between a door and a door jam. The plugs 43 may or may not be included with the exercise kit 10.

At least two rocker covers 44 are contained in each exercise kit 10. The rocker covers 44 have on the underside thereof rips 45 for providing structural strength. Within the ribs 45 is located a cradle 46 in which the handle 16 of the body rocker 12 may rest. Horizontal posts 47 extend horizontally at one end of the cradle 46. The horizontal post 47 may connect into holes 18 located on one end of the body rocker 12 as will be explained in more detail subsequently.

To complete the exercise kit 10 is an instructional booklet 48 and exercise music and/or video located on disc 50. The complete exercise kit may be inserted into bag 52 which may be closed by drawstring 54 and easily carried by the end user. The drawstring 54 are of sufficient length that they can reach over both shoulders of an individual with the exercise kit 10 being easily carried on one's back much the same way a back pack would be carried.

Figure 2:
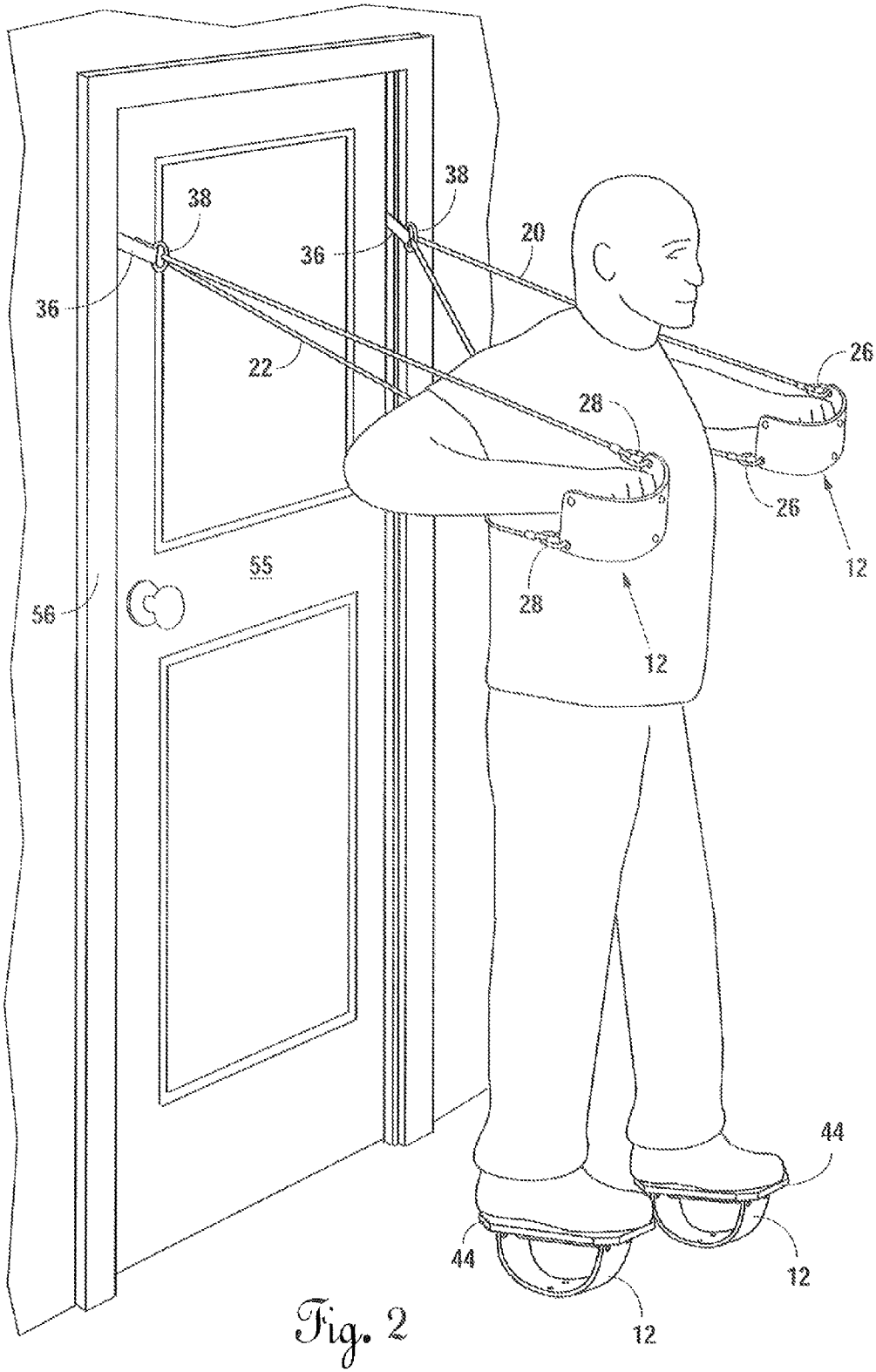
FIG. 2 is an example of an exercise that can be performed with the exercise kit shown in FIG. 1 with an additional set of body rockers.
Figure 3:
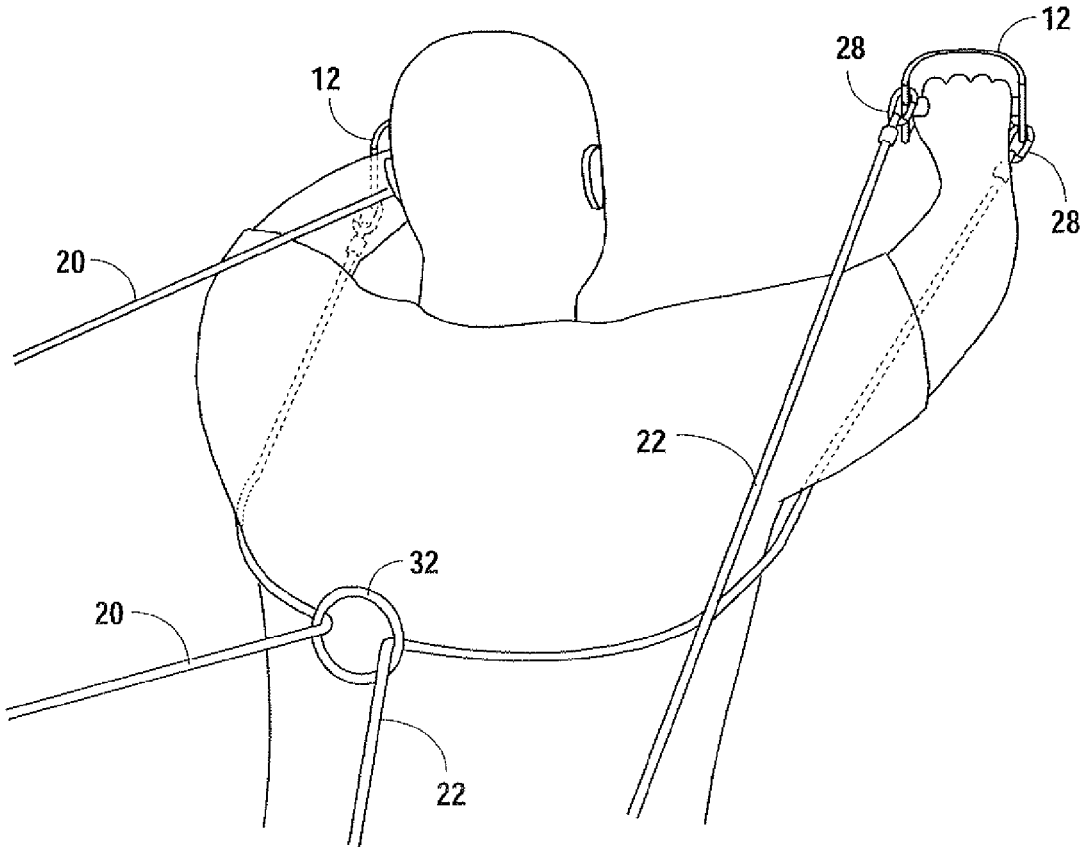
FIG. 3 is another example of an exercise that can be performed with the exercise kit shown in FIG. 1.

Referring now to FIGS. 2 and 3 in combination, an exercise kit 10 that has four body rockers 12 is shown and how the kit 10 could easily be used. The door straps 36 are inserted between door 55 and door frame 56. The retaining loops 40 along with the plugs 43 (not shown in FIGS. 2 and 3) prevents the door straps 36 from being pulled through the crack between the door 55 and the door frame 56.

A pair of body rockers are being held by the person doing the exercise as shown in FIG. 2. Connected to the body rocker 12 contained in the right hand is elastic cord 22 that connects through carabiner 28. The elastic cord 22 also goes through the solid ring 32 at the user's book (see FIG. 3) and ring 38 of door strap 36 immediately behind the right shoulder of the individual user. The body rocker 12 that is in the left hand connects to elastic cord 20 via carabiner 26 and extends through solid ring 32 and through ring 38 of door strap 36 behind the individuals left shoulder. By extending the arms towards the front of the individual user, the triceps, biceps and brachialis muscles of the upper arm are exercised. In the forearm, additional muscles including the brachioradialis, flexor carpi radialis, and palmaris longus are exercised. In the shoulder, the trapezius and deltoid muscles are exercised. The amount of energy used to extend each of the body rockers 12 can be varied be either increasing the elastic strength of the cord or by shortening the cord so that it is closer to the elastic limit.

To add an additional balancing feature that would involve the thigh and leg muscles, an additional body rocker 12 is located below each foot of the individual user, which body rocker has a rocker cover 44 on the top thereof. Now as the individual extends their arms, an additional rocking feature is provided to the leg.

Figure 4:
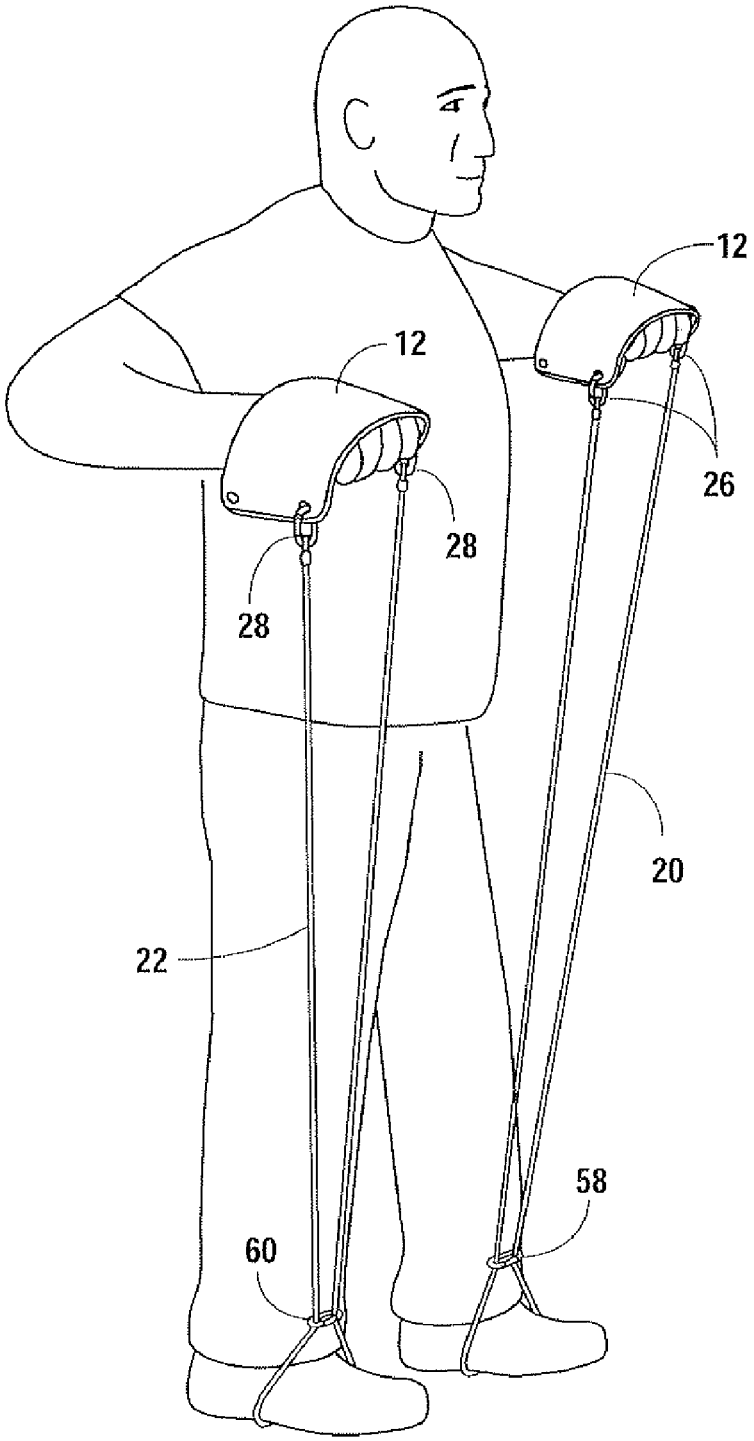
FIG. 4 is another example of an exercise that can be performed with the exercise kit shown in FIG. 1.

Referring to FIG. 4, an additional exercise that is good for the arm and forearm is illustrated when a body rocker 12 is held in each hand. The elastic cord 22 connected to body rocker 12 on the right hand extends below the right foot through an extra carabiner 60 and back up through carabiners 28 to connect to the body rocker 12. Likewise connected to the body rocker 12 on the left hand of the individual is elastic cord 20 connected by carabiners 26 and extending through extra carabiner 58 around the left foot of the individual. By continually raising and lowering the left and right arms, a lot of tension can be put on the forearms including the brachiordialis, extensor carpi radialis longus, flexor carpi ulnaris, extensor carpi ulnaris, and extensor bigitorum muscles. Additional exercising of the shoulder muscles will also occur.

Another static exercise that is not shown is holding a body rocker 12 in each hand and pressing the body rockers together and rotating in and out. This is a static exercise with one body rocker pushing against the other when held in each band.

While not illustrated in FIG. 2, the door straps 36 can be at the lower part of the door 55 between the door 55 and door jam 56. In this manner, the elastic cords can be connected so that one can sit on the floor and exercise their legs and thighs. Also exercises for the legs and thighs can be provided by wrapping the elastic cord around ones back and extending and retracting the legs.

Figure 5:
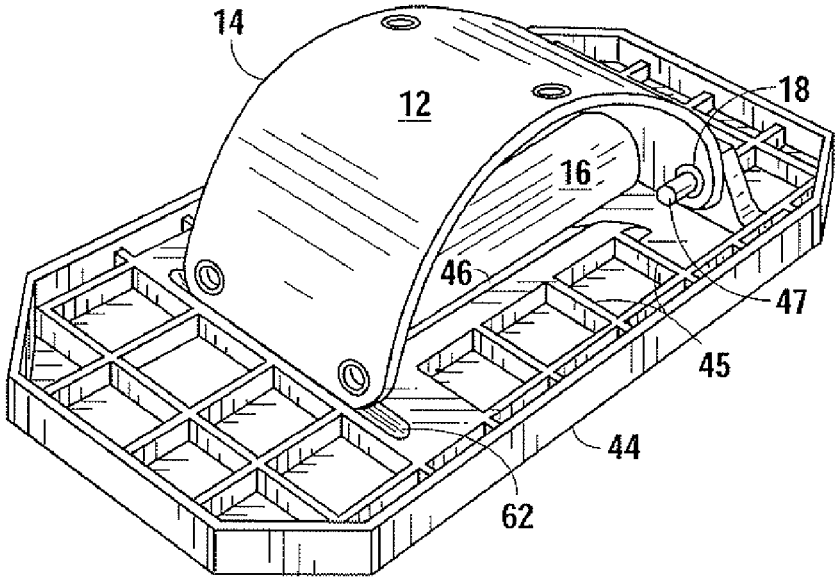
FIG. 5 is a perspective of a bottom side of a body rocker with a rocker cover.
Figure 6:
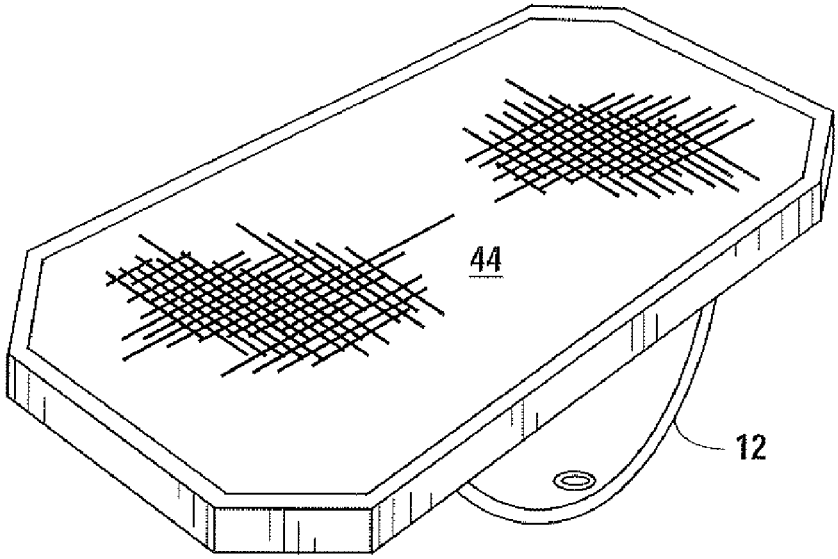
FIG. 6 is an opposing perspective view from FIG. 5.

Referring to FIGS. 5 and 6 in combination, a further description of the body rocker 12 as used in combination with the rocker covers 44 is provided. Ribs 45 on the underside of the rocker cover 44 provides strength for the rocker cover 44 while still keeping it lightweight. Cradle 46 allows the handle 16 of the rocker cover 12 to fit snuggly therein. To connect the body rocker 12 and the rocker cover 44 together, holes 18 on one end of the arcuate 14 plate of rocker cover 12 are positioned over horizontal posts 47. The opposite end of the arcuate plate 14 rests in channel 62 of the rocker cover 44. In that manner, when someone stands on the rocker cover 44 as illustrated in FIG. 2, the rocker cover 44 will remain firmly pressed against the body rocker 12.

Figure 7:
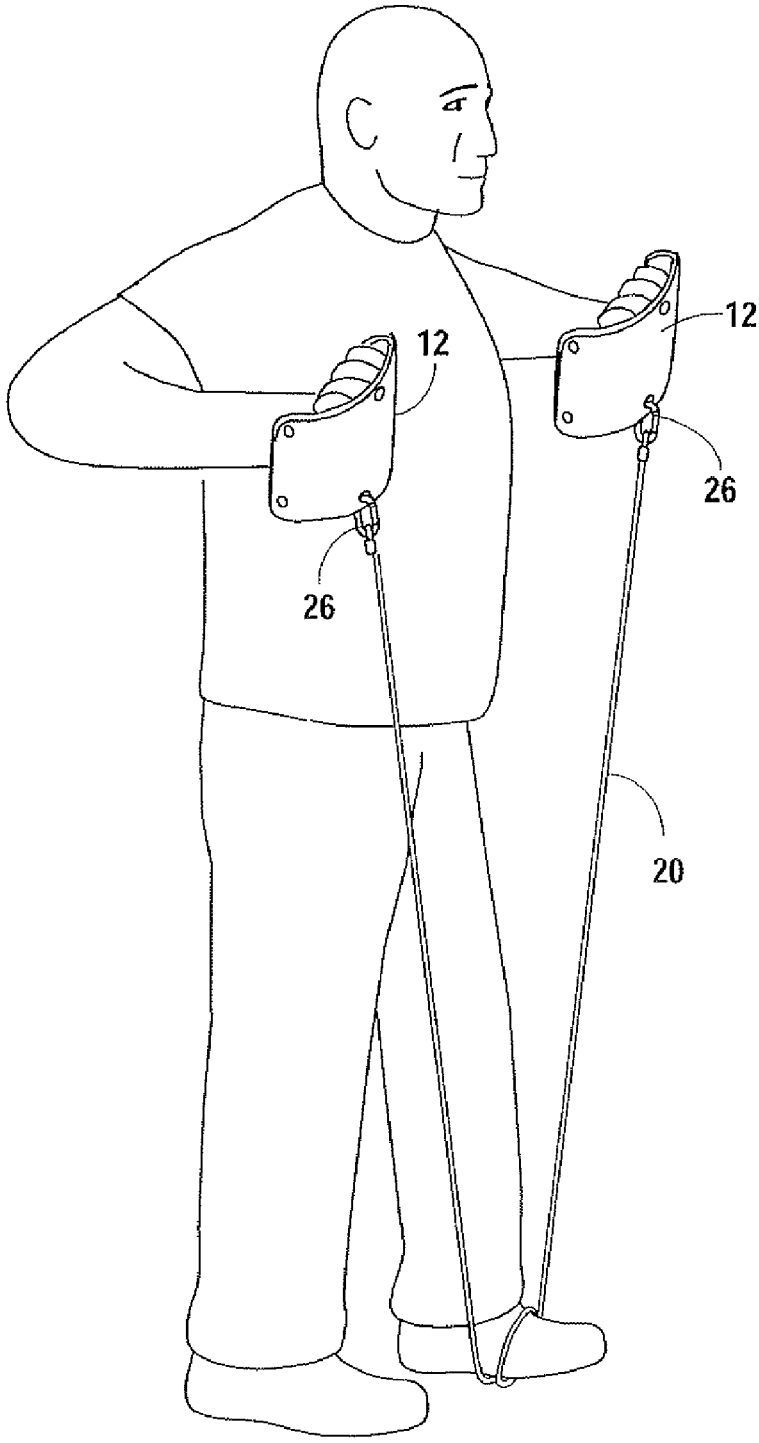
FIG. 7 is yet another example of an exercise that can be performed with the exercise kit shown in FIG. 1.

Referring now to FIG. 7, another exercise is illustrated for using body rockers with a single cord 20 connected by carabiners 26. The elastic cord 20 is wrapped around the foot of the individual that is exercising. With the cord 20 wrapped around the individuals foot, a whole series of exercises that stretch the elastic cord 20 can be designed. A push up exercise, pull up exercise or push out exercise can all be used. Even exercises of the legs can be designed due to the wrapping of the elastic cord around the foot.

Figure 8:
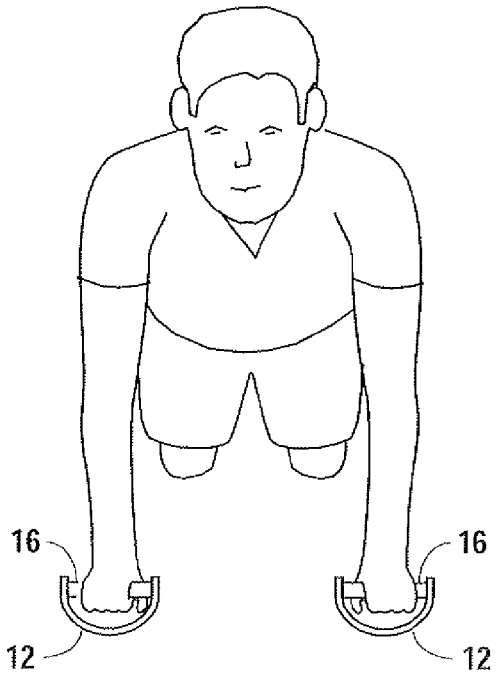
FIG. 8 is an example of push ups being performed with the body rockers.

FIG. 8 represents an individual using the body rockers 12 and gripping the handle 16 so that as the person goes down for a push up, the body rockers 12 will rock in and out. This gives additional exercise of the hands and forearms as the person is completing the push up. This is a more complete exercise while doing push ups than the normal style push up.

Figure 9:
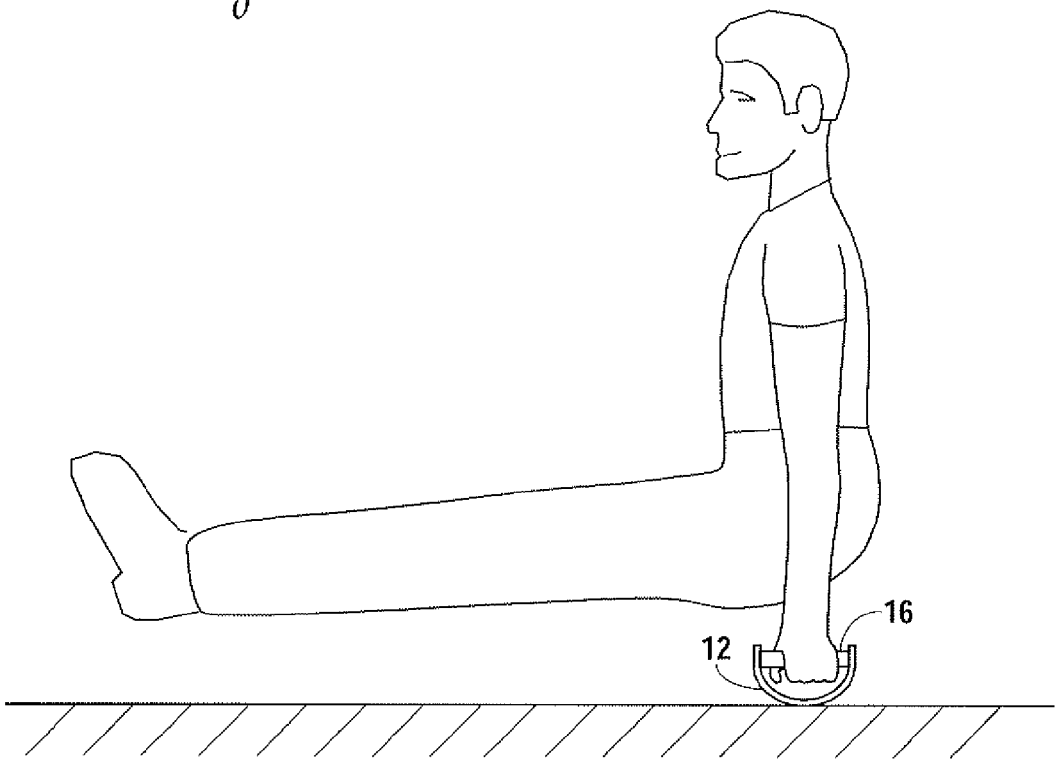
FIG. 9 is an example of another exercise being performed with the body rockers.

A similar type exercise can be done for hand stands as illustrated in FIG. 9 where an individual grips the handle 16 of the body rockers 12. This may be done with the feet up or the feet touching the floor. Again, the hands will rock back and forth to give a more complete exercise of the hands, arms and forearms. While FIGS. 8 and 9 just describe two exercises using just the body rockers 12, a whole series of different similar types of exercises can be utilized.

Figure 10:
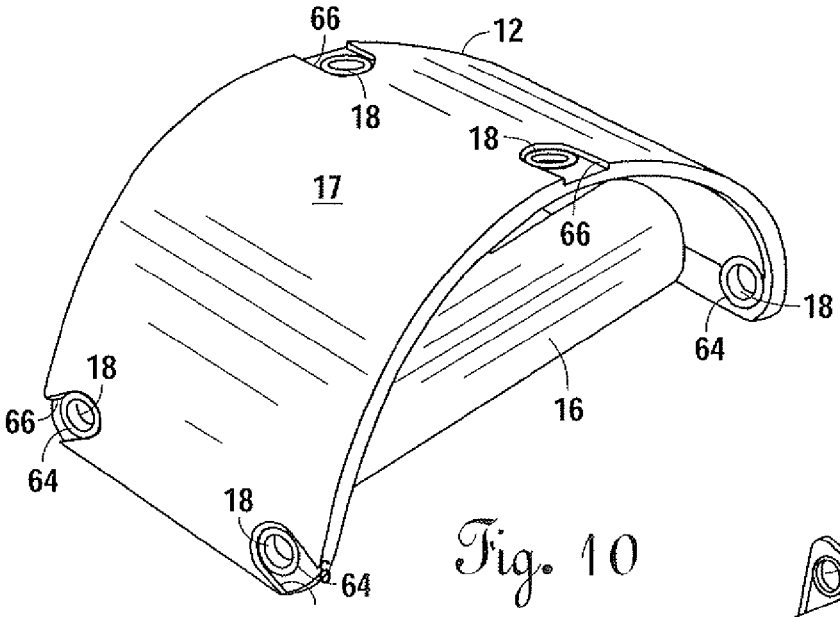
FIG. 10 is a perspective view of a body rocker.
Figure 11:
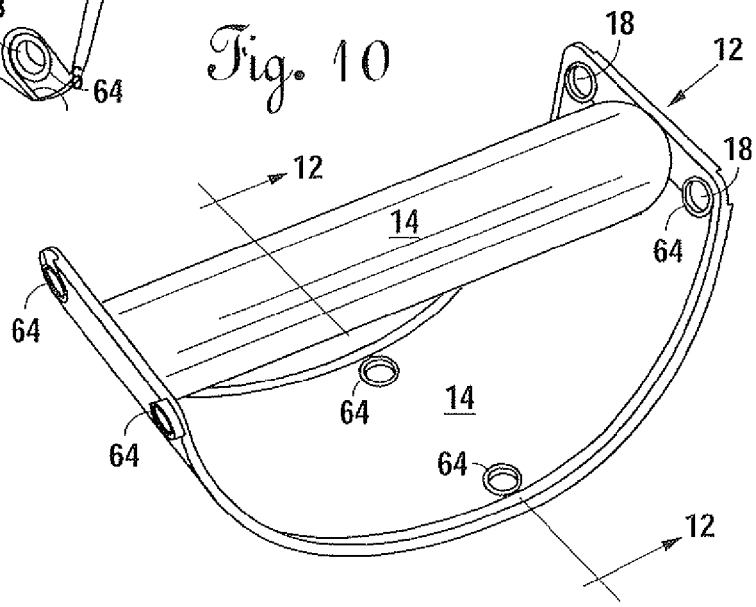
FIG. 11 is an opposing perspective view from FIG. 10.
Figure 12:
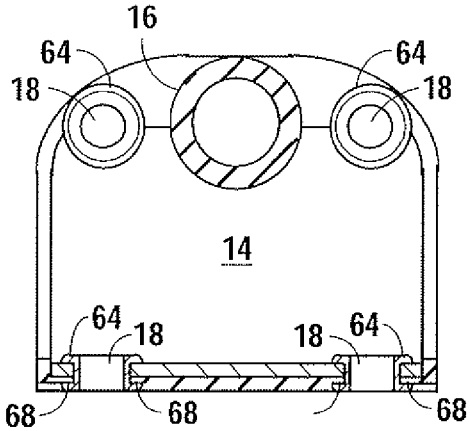
FIG. 12 is a cross-sectional view of FIG. 11 along section lines 12-12.

To keep the body rockers 12 from scratching furniture floors or other fixtures, the body rockers 12 are coated with an elastic gripping material 17 as is illustrated in FIGS. 10, 11 and 12. The handle 16 still extend to the opposite ends of the arcuate plate 14 of the body rockers 12 and is connected thereto by any suitable means such as welding. In each of the holes 18 in the arcuate plate 14 is located a revit 64. The rivit 64 is located in a recess 66 of the elastic gripping material 17 so that the top of the revits 64 will not scratch against any surfaces. However, the revit 64 still holds a flange 68 of the elastic gripping material 17 so that it will not pull lose from the body rocker 12. Also, the elastic gripping material 17 should be glued to the arcuate plate 14. In this manner, the elastic cords 20, 22, 24 or 25 can be quickly connected via the carabiners 26, 28, 30 or 31 to any particular hole 18 and the revit 64 located therein.

The exercise kit as just described, through the use of the body rockers 12 along with the elastic cords 20, 22, 24 and 25 can be used for any number of exercises by quickly connecting the carbiners 26, 28, 30 or 31. Thereafter, the individual pushes against the elastic cord with the exercises being performed. The door strap 36 provides an additional way for the individual connecting the elastic cord 20, 22, 24 or 25 to a fixed structure while exercising. Additional body rockers, carabiners or rings can be used as desired by the individual.

We claim:

1. A lightweight, portable exercise kit that can be used anywhere there is a door mounted in door frame for various resistance exercises to be performed by the user, the kit comprising:

at least a pair of body rockers having an arcuate plate and a handle connected between on either end thereof, said arcuate plate having holes near an outer edge thereof for connecting thereto;

door straps made of a flexible material for extending between said door and said door frame, a first end of said door straps having a retaining loop and a second end having a ring attached thereto;

elastic cords of various lengths and strengths;

carabiners connected to each end of said elastic cords, said carabiners being connectible between said rings of said door straps on a first end and said holes in said body rockers on a second end according to an exercise being performed by said used;

said user stretching said elastic cords with said body rockers in a manner dependant on the exercise being performed by the user.

2. The lightweight portable exercise kit as given in claim 1 wherein said arcuate plate is coated with an elastic gripping material.

3. The lightweight, portable exercise kit as given in claim 2 further including at least one ring through which said elastic cords may extend during exercise.

4. The lightweight, portable exercise kit as given in claim 3 further including rocker covers for attaching to and covering said body rocker during some exercises.

5. The lightweight, portable exercise kit as given in claim 4 wherein said rocker covers have ribs for reinforcement and a cradle in which said handle can rest.

6. The lightweight, portable exercise kit as given in claim 5 wherein said rocker covers include horizontal posts for extending into said holes of said arcuate plate when said handle is in said cradle.

7. The lightweight, portable exercise kit as given in claim 6 further including a bag in which to carry said kit, said bag having a drawstring for closing said bag and carrying said kit.

8. The lightweight, portable exercise kit as given in claim 7 includes an instruction manual and disc.

9. The lightweight, portable exercise kit as given in claim 2 wherein said holes in said arcuate plate have revits therein for holding said elastic gripping material in place on said arcuate plate.

10. The lightweight, portable exercise kit as given in claim 9 wherein said holes in said body rockers are in at least each corner thereof.

* * * * *